US005485814A

United States Patent [19]

Tuggle et al.

[11] Patent Number: 5,485,814

[45] Date of Patent: Jan. 23, 1996

[54] RESETTING IGNITION SWITCH FOR A GASOLINE POWERED CHAIN SAW

[75] Inventors: Lloyd H. Tuggle; Paul A. Warfel, both of Shreveport, La.

[73] Assignee: WCI Outdoor Products, Inc., Cleveland, Ohio

[21] Appl. No.: 396,676

[22] Filed: Mar. 1, 1995

[51] Int. Cl.[6] ..... F02D 37/02

[52] U.S. Cl. ..... 123/179.5; 123/179.18

[58] Field of Search ..... 123/179.5, 179.18, 123/179.16, 198 DC

[56] References Cited

U.S. PATENT DOCUMENTS

| | | | |
|---|---|---|---|
| 2,791,207 | 5/1957 | Rayniak | 261/39.1 |
| 4,079,708 | 3/1978 | Wieland et al. | 123/376 |
| 4,919,091 | 4/1990 | Wissmann et al. | 123/179.5 |
| 5,209,196 | 5/1993 | Nickel et al. | 123/179.5 |
| 5,215,049 | 6/1993 | Wolf | 123/179.18 |

*Primary Examiner*—Andrew M. Dolinar

*Attorney, Agent, or Firm*—Pearne, Gordon, McCoy & Granger

[57] ABSTRACT

A resetting ignition switch for a portable power tool whereby movement of a choke assembly from a first, normal position to a second, choking position simultaneously and automatically moves an ignition switch from a stop to a run position to permit starting of the engine. The ignition switch, which forms a portion of an ignition circuit for the power tool, includes an integral lever which extends across a body of the power tool and relatively beneath a shaft of the choke. The shaft includes a depending arm which engages and rotates the lever as the shaft is moved longitudinally from its normal position toward its choking position. Rotation of the lever causes the ignition switch to pivotally move from the stop to the run position. The ignition switch is movably without interference from the choke assembly when the choke assembly is in its normal position.

17 Claims, 6 Drawing Sheets

RESETTING IGNITION SWITCH FOR A GASOLINE POWERED CHAIN SAW

BACKGROUND OF THE INVENTION

1. Field of the Invention

The present invention generally relates to ignition circuits and, more particularly, to ignition circuits and systems for portable power tools.

2. Description of Related Art

Portable power tools such as chain saws, string trimmers, hedge trimmers, edgers, and blowers typically have two-stroke gasoline engines which require manual choking to provide a fuel rich mixture to the engine during manual cold starting thereof. Such power tools conventionally include a manually-operated choke assembly and a separate ignition or "kill" switch. The ignition switch is manually movable between an ignition or run position wherein ignition of fuel within the engine is permitted and a stop position wherein ignition is prevented. The ignition switch is primarily provided to allow the operator to turn the power tool off when desired.

Traditionally, manual operation of the choke assembly to supply a fuel-rich mixture to the engine, which facilitates cold starting of the power tool, is completely separate from the necessary re-setting of the ignition switch to the run position. It has been found that, while the operator normally remembers to operate the choke assembly, he or she quite often forgets to manually move the ignition switch to the run position before attempting to start the engine.

Failure to place the ignition switch in the run position prevents starting of the power tool and, due to the oversupply of fuel to the engine, the engine is eventually flooded. Flooding of the engine makes starting of the engine difficult or impossible should the operator subsequently place the ignition switch in the run position, and typically forces the operator to wait a period of time until the "flooded" condition of the engine has been resolved.

In response to this problem, several solutions have been proposed. One solution, set forth in U.S. Pat. No. 2,791,207, utilizes a combined choke and ignition or kill switch actuator. The actuator is moved in or out to adjust the choking of the engine, and is rotated to move the ignition switch between the run and off positions. When the actuator is in the run position and is pulled out to choke the engine, it cannot be rotated to the "off" position. Similarly, when the actuator is in the "off" position, it cannot be pulled out to choke the engine.

Another solution is presented in U.S. Pat. No. 5,209,196. The '196 patent discloses an operating mode selector which includes an ignition switch. The mode selector is movable between various positions, such as off, idle, cold start, and warm start. The ignition switch is connected to the throttle and choke flaps via linkages. U.S. Pat. Nos. 4,079,708 and 5,215,049 show other selector switches which control positioning of the throttle and choke flaps.

Another approach to solving the problem presented by operators trying to start the engine without placing the ignition switch in the run position is set forth in U.S. Pat. No. 4,919,091. The '091 patent discloses a device for automatically resetting an ignition switch unit to the run or start position. The ignition switch unit includes a latching member which is biased to the start position. A positioning member, which includes the user-engagable ignition switch, engages the latching member and holds the latching member in the "off" position. When the engine coasts to a standstill, the positioning member disengages the latching member and allows the latching member to move to its at-rest or start position. A second embodiment of the '091 includes a push actuator which can be latched in a position to disable ignition.

The aforementioned patents disclose various devices and methods for preventing the operator from neglecting to reset the ignition switch from the stop to the run position. However, the solutions posed by these patents are typically expensive to implement, and result in more costly portable power tool. Moreover, the integration of the operation of the ignition switch and choke into a single selector switch, as taught by some of these patents, is undesirable for operators who have grown accustomed to choke assemblies and ignition switches which are separate and independently operable. Finally, the selector switches or mechanisms taught by some of these patents may be difficult for the operator to quickly locate and operate should operation of the power tool need to be quickly terminated.

Therefore, there exists a need in the art for a simple and inexpensive device which operably links the choke assembly and the kill switch whereby operation of the choke assembly to supply a fuel-rich mixture to the engine necessarily moves the ignition switch into the run position and allows starting of the power tool. There also exists a need in the art for device which allows independent operation of the ignition switch when the choke assembly is in its normal or non-choking position. Finally, there exists a need in the art for a device which appears to be a conventional power tool having an ignition switch which is operable independently of a choke assembly, but in which the choke assembly is operably linked to the ignition switch so that the ignition switch is automatically moved to the run position when the choke assembly is moved from a non-choking to a choking position.

SUMMARY OF THE INVENTION

The present invention provides an ignition system for a portable power tool, such as a chain saw, string trimmer, hedge trimmer, edger, or blower, wherein an ignition switch is automatically reset from a stop position to a run position by movement of a choke assembly from a normal, first position into a choking, second position.

In accordance with the present invention, the choke assembly is manually movable between the normal, first position and the choking, second position and the ignition switch is manually movable between the run position and the stop position. A member operatively interconnects the choke assembly and the ignition switch whereby movement of the choke assembly into the choking, second position moves the ignition switch into the run position, and wherein the ignition switch is freely movable independent of the choke assembly when the choke assembly is in the normal, first position.

In further accordance with the present invention, the choke assembly includes a handle and a shaft while the member interconnecting the choke assembly and the ignition switch is provided by a lever integrally formed with the ignition switch.

In further accordance with the present invention, the handle and shaft are longitudinally movable between the normal and choking positions. The shaft includes an arm which engages and rotates the lever as the handle and shaft are moved from the normal position into the choking position. Rotation of the lever pivots or rotates the ignition switch from the stop position to the run position.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1A:
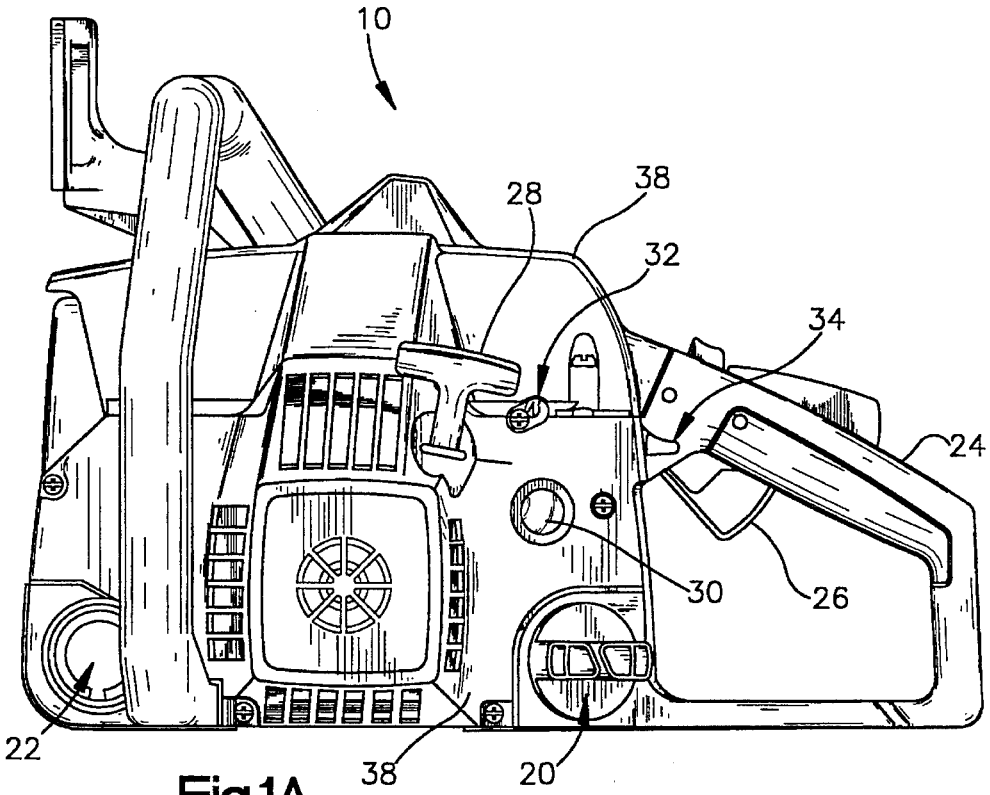
FIG. 1A is a side elevational view of a chain saw power head incorporating the present invention.
Figure 1B:
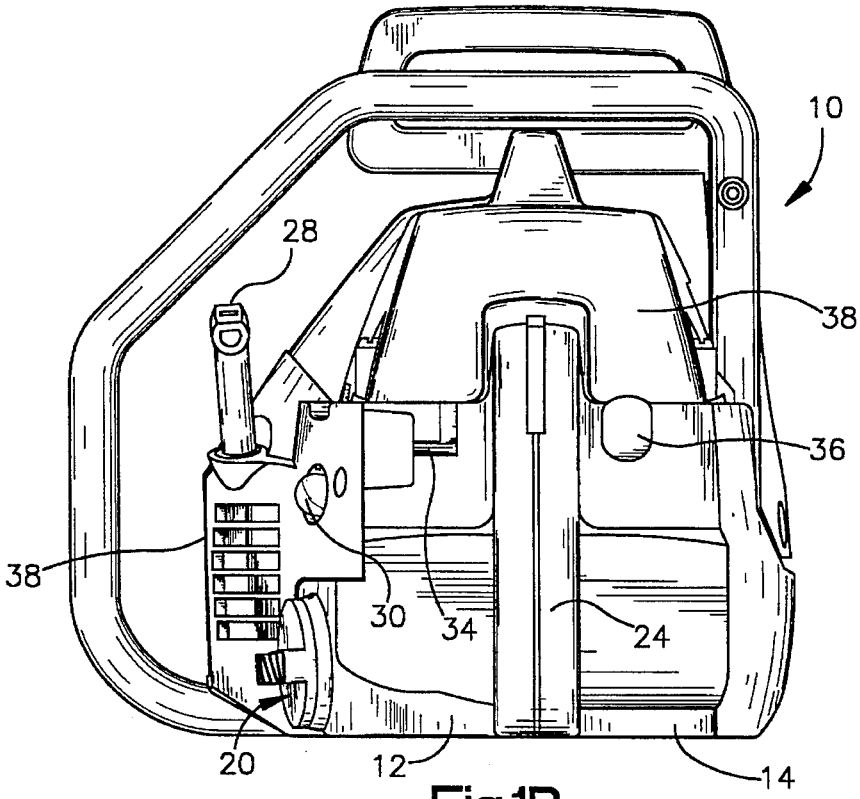
FIG. 1B is a rear elevational view of the chain saw power head shown in FIG. 1A.
Figure 2A:
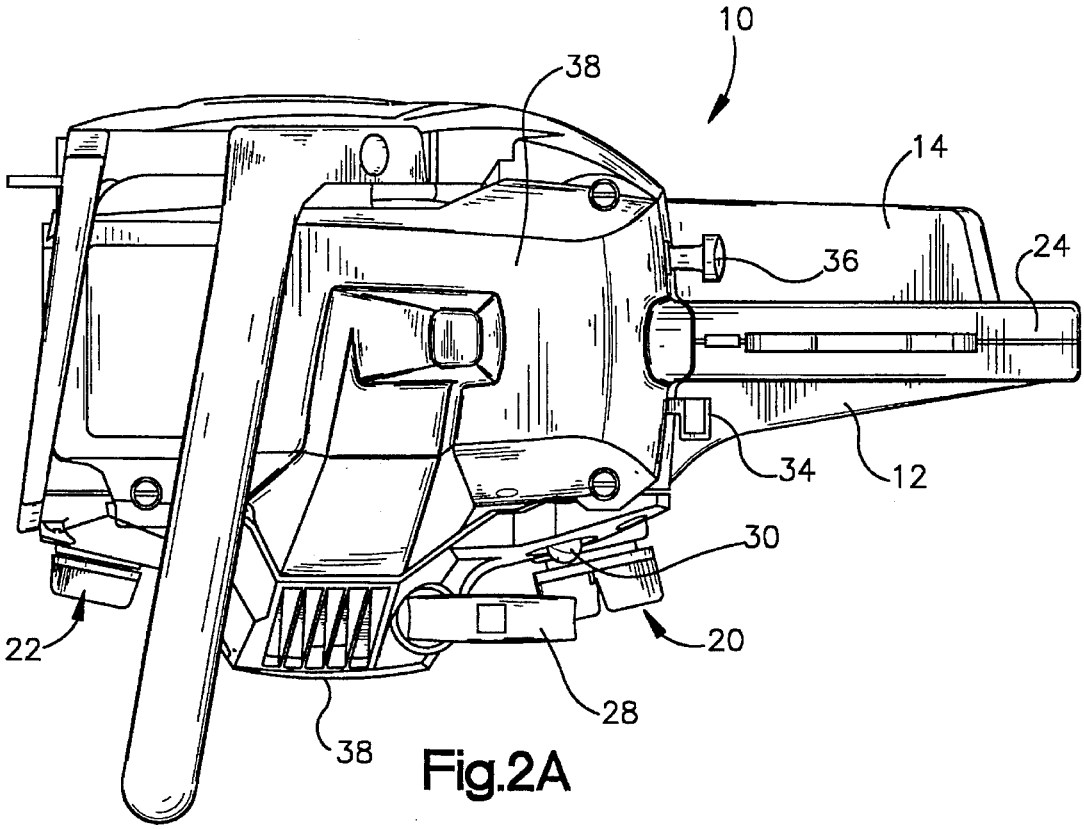
FIG. 2A is a top plan view of the power head shown in FIGS. 1A and 1B.

With reference to the drawing figures, and specifically FIGS. 1A, 1B, and 2A, a chain saw power head 10 incorporating the present invention is illustrated. The power head 10 includes a chassis having first and second lateral halves 12, 14 on which a two-stroke internal combustion engine 16 is mounted and to which a series of covers or guards 18 are attached. The first and second chassis halves 12, 14 cooperate to define a fuel tank 20, a chain oil tank 22, and a rear handle 24. The rear handle 24 has a throttle 26 secured thereto which an operator manipulates to control the operating speed of the engine 16 and, hence, the cutting chain (not shown) which is operably attached to an engine crankshaft via appropriate gearing, as is well known in the art. The engine 16 is secured, via mounting bolts (not shown), to each of the chassis halves 12, 14 from below.

Several control elements, in addition to the throttle 26, are accessible to the operator on the exterior of the power head 10. These control elements include a manual rope starter handle 28, primer bulb 30, a double screw carburetor adjustment device 32 for adjusting the idle and choking fuel supplies, an ignition switch 34, and a choke handle or knob 36 of a choking assembly 44. The rope starter handle is pulled by the operator to rotate a flywheel (not shown) for staring of the engine 16, as is well known in the art. An ignition module 40 (FIGS. 7A, 7B) is located adjacent the flywheel and transmits current pulses to a spark plug 66 as the flywheel rotates, as is well known in the art.

Figure 2B:
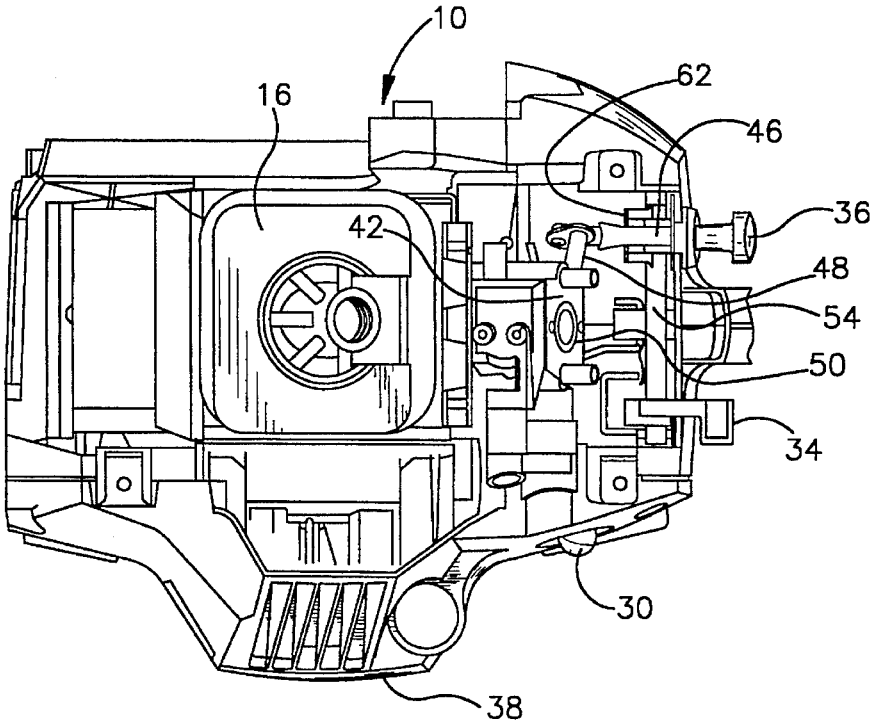
FIG. 2B is a top plan view of the power head shown in FIG. 2A, with a top shield removed therefrom.
Figure 3:
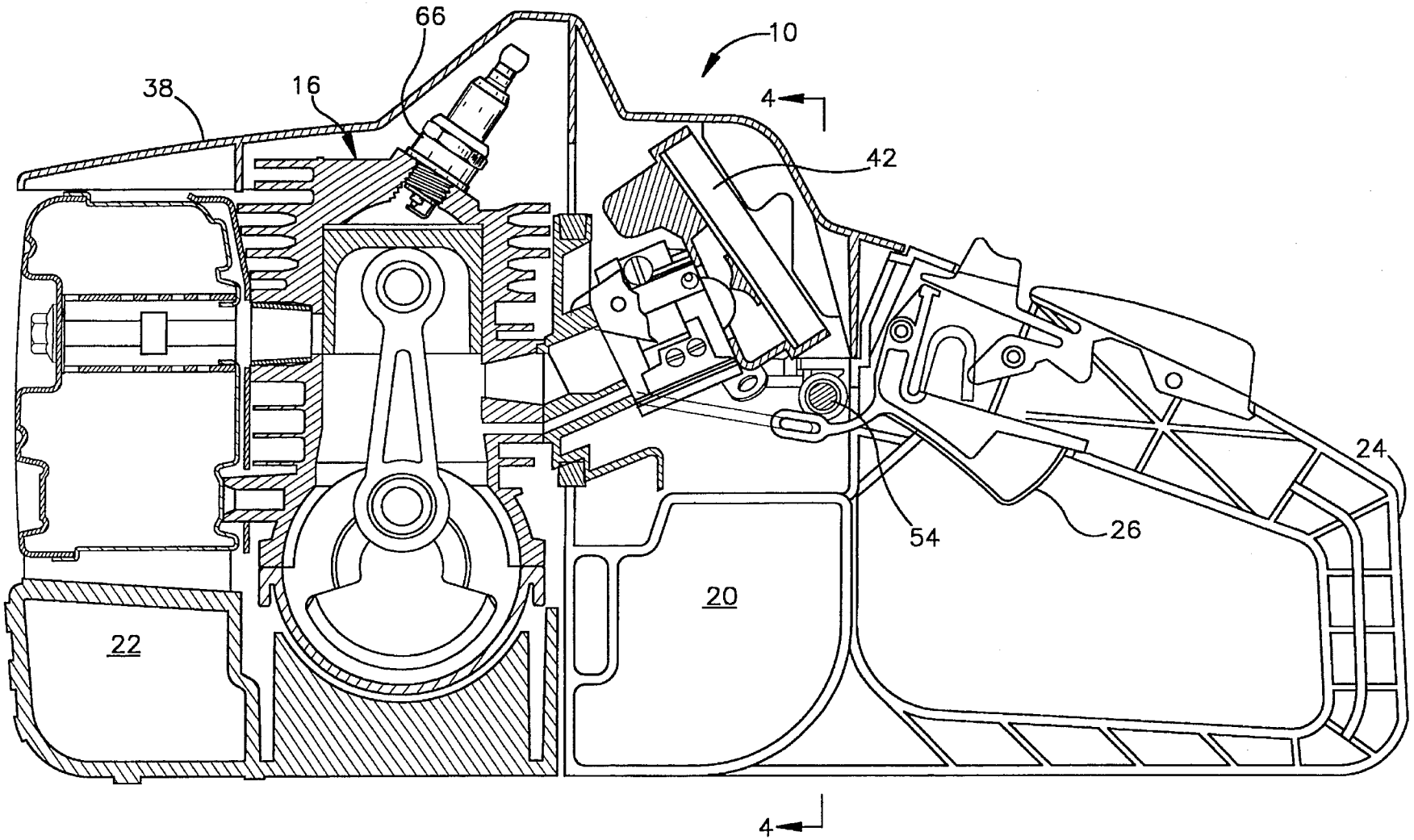
FIG. 3 is a side elevational view, in cross section, of the power head shown in FIGS. 1A–2B.
Figure 4:
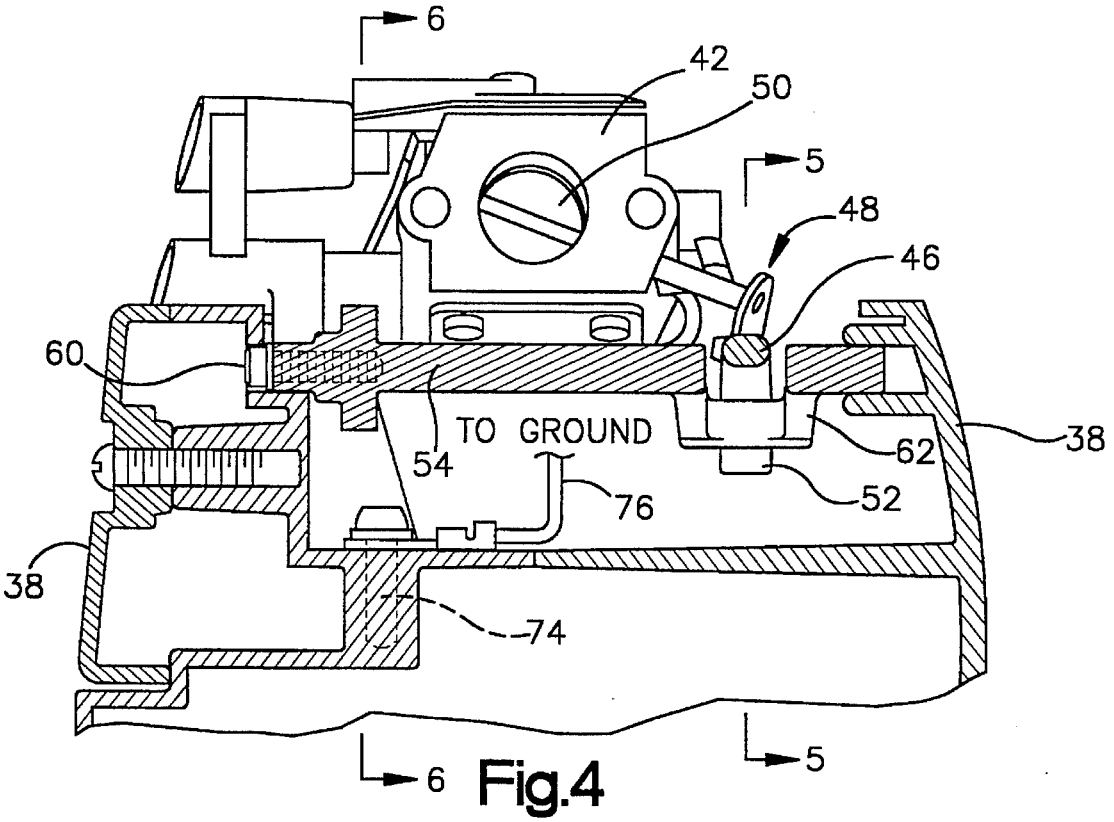
FIG. 4 is a side elevational view, in cross section, of the power head as seen from line 4—4 of FIG. 3.

With reference to FIGS. 2B and 4, the interior of the chain saw power head 10 is illustrated. The carburetor 42 is located rearwardly of the engine 16. The choke assembly 44 is rearwardly and downwardly spaced from the carburetor 42 and includes a choke shaft 46 extending inwardly from the choke knob 36. The choke shaft 46 is connected, via linkage 48, to a butterfly valve 50 which controls the introduction of air into the carburetor 42. As such, movement of the choke knob and shaft 36, 46 from a normal, first position to a choking, second position causes the butterfly valve 50 to pivotally close which, in turn, provides a relatively fuel-rich air-fuel mixture to the engine 16.

Figure 5A:
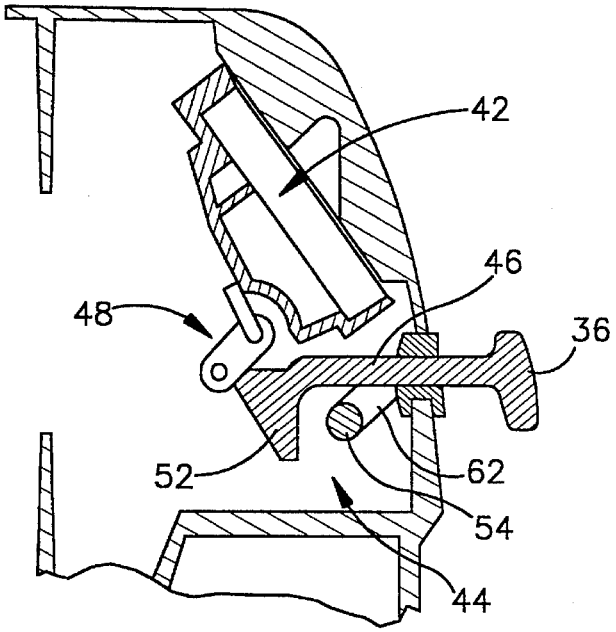
FIG. 5A is a sectional view of a choke knob in a normal, first position, as seen along line 5—5 of FIG. 4.
Figure 5B:
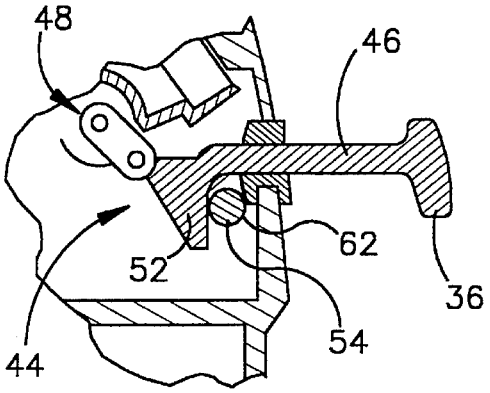
FIG. 5B is a sectional view of the choke knob in a choking, second position, as seen along line 5—5 of FIG. 4.

With reference to FIGS. 4 and 5A–5B, the choke shaft 46 is shown to include a depending arm 52. The arm 52 is located generally at an end of the shaft 46 adjacent the choke linkage 48, and is operable to engage a portion of a lever 54 associated with the ignition switch 34.

Figure 6A:
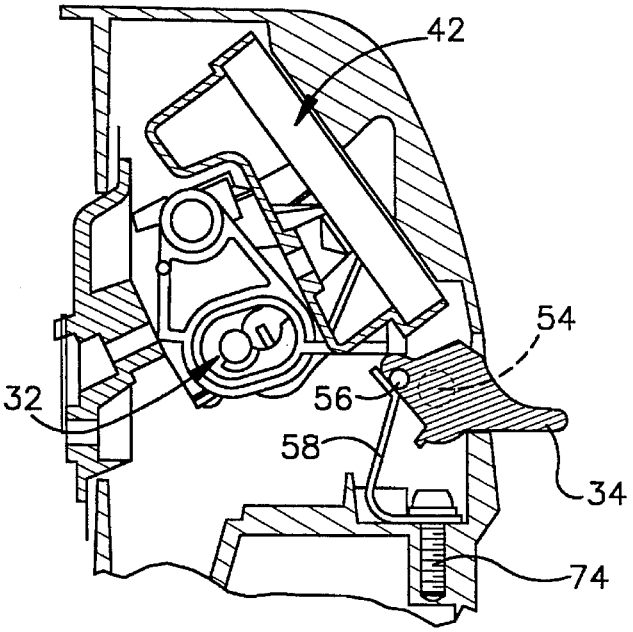
FIG. 6A is a sectional view of an ignition switch in a stop or ignition-preventing position, as seen along line 6—6 of FIG. 4.
Figure 6B:
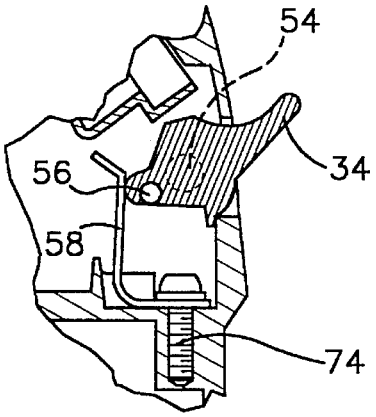
FIG. 6B is a sectional view of the ignition switch in a run or ignition-permitting position, as seen along line 6—6 of FIG. 4.

The ignition switch 34 is mounted on an opposite side of the power tool rear handle 24 relative to the choke knob 36. The ignition switch 34 is pivotally secured to a cover 38 overlying the first chassis half 12 (FIG. 4), and is pivotally movable between a stop or ignition preventing position (FIG. 6A) and a run or ignition permitting position (FIG. 6B). The ignition switch 34 includes a switch contact 56 which engages a flat metal spring 58 when the ignition switch 34 is in the stop position. Engagement between the switch contact 56 and the spring 58 grounds the ignition circuit, as will be described more fully hereafter with reference to FIGS. 7A and 7B. In addition to its function as a portion of the ground path for the ignition system, the metal spring 58 retains the ignition switch 34 in the run position.

The ignition switch 34 integrally includes the lever 54 which is operably associated with the choke assembly 44. As shown best in FIGS. 2B and 4, the ignition switch 34 is rotatably secured to the first chassis half 12 via a screw 60 and the lever 54 is journalled or rotatably mounted to a cover 38 overlying the second chassis half 14. The lever 54 has a longitudinal axis and a U-shaped offset portion 62 which diverges from the axis of the lever 54. The offset portion 62 extends downwardly and inwardly a short distance when the choke assembly 44 is in the normal, first position (FIG. 5A) and is engaged by the depending arm 52 of the choke shaft 46 as the choke knob and shaft 36, 46 are pulled outwardly from the normal position (FIG. 5A) toward the choking position shown in FIG. 5B, causing the lever 54 to rotate about its axis and move or pivot the ignition switch 34 from the stop position shown in FIG. 6A to the run position shown in FIG. 6B.

Figure 7A:
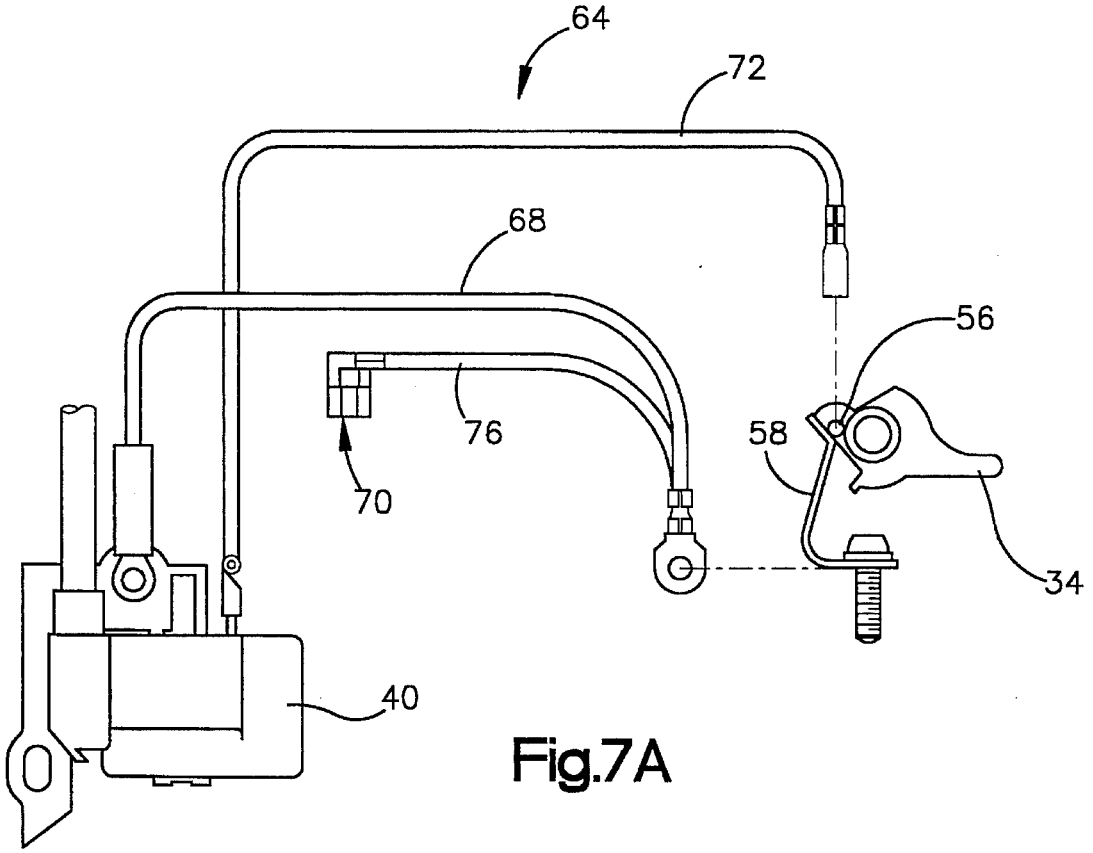
FIG. 7A shows an ignition circuit according to the present invention.
Figure 7B:
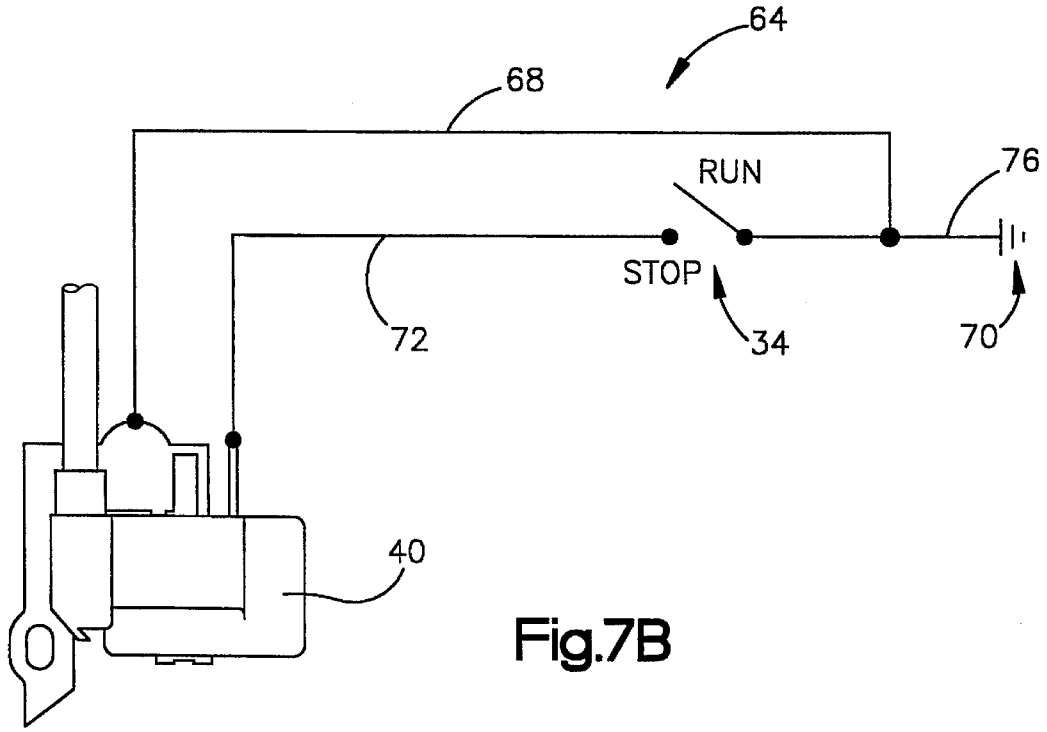
FIG. 7B is a schematic drawing of the ignition circuit shown in FIG. 7A.

The ignition circuit 64 of the portable power tool incorporating the present invention is shown in FIGS. 7A and 7B. The ignition module 40, which is located adjacent the flywheel, develops current pulses in response to rotation of a flywheel-carried permanent magnet therepast. The current pulses are transmitted to the spark plug 66 and are used to ignite the fuel-air mixture within the cylinder.

The ignition module 40 is connected, via ground wires 68, 76, to engine ground 70 and, via a lead wire 72, to the contact 56 on the ignition switch 34. The flat spring 58 is connected to ground 70 via a screw 74 and an engine ground wire 76. Therefore, when the ignition switch contact 56 engages the flat metal spring 58, the ignition module 40 is grounded and does not provide current pulses to the spark plug 66. On the other hand, when the ignition switch contact 56 is rotated out of engagement with the flat spring 58, the ignition module 40 is not grounded and, therefore, is able to deliver current pulses to the spark plug 66.

Starting of the chain saw shown in the drawing figures will be discussed hereafter with reference to the foregoing description and drawing figures. When the chain saw is to be cold started, the choke knob and shaft 36, 46 are pulled outwardly from the normal, first position to the choking, second position. Longitudinal movement of the choke shaft 46 causes the butterfly valve 50 to pivotally move to a more closed position, and reduces the amount of air delivered to the air-fuel mixture supplied to the engine 16.

Movement of the choke shaft 46 also causes the arm 52 depending therefrom to engage the offset portion 62 of the lever 54, and rotates the lever 54 about its longitudinal axis. Rotation of the lever 54 pivots the ignition switch 34 from the stop position, wherein the ignition switch contact 56 engages the flat spring 58 and grounds the ignition module 34, to the run position wherein the ignition switch contact 56 is spaced from the metal spring 58 and the ignition module 40 is operable to supply current pulses to the spark plug 66.

The priming bulb 30 is pumped a number of times to supply a fuel charge to the carburetor 42. Thereafter, the rope starter 28 is pulled one or more times to rotate the flywheel and cause the ignition module 40 to supply spark-generating pulses to the spark plug 66. When the engine 16 attempts to start or "fire", the choke assembly 44 is moved to a half-choke position intermediate the normal, first position and the choking, second position. The ignition switch 34 is maintained in the run position by the flat metal spring 58. Placing the choke assembly 44 in the half-choke position allows additional air to flow through the butterfly valve 50 and makes the air-fuel mixture introduced into the engine 16 from the carburetor 42 less fuel-rich. Subsequent pulling of the rope starter 28 results in ignition of the air-fuel mixture within the engine cylinder, starting the engine 16. The choke knob and shaft 36, 46 are then pushed inwardly to their normal, first position to open the butterfly valve 50 to its normal operating position.

When it is desired to turn the power tool off, the ignition switch 34 is simply rotated or pivoted from the run position to the stop position wherein the ignition module 40 is grounded and ceases to supply current pulses to the spark plug 66. Movement of the ignition switch 34 to the stop position is against the biasing force of the flat spring 58, but is free of interference from the choke shaft arm 52, which is relatively inwardly spaced from the offset portion 62 of the lever 54.

The present invention provides a device which insures that the ignition switch 34 is in the run position when the choke assembly 44 is placed in the choking position for cold-starting of the internal combustion engine 16 while allowing the ignition switch 34 to be returned to the off position without interference from the choke assembly 44 when the choke assembly is in its normal operating position. The means for linking the operation of the choke assembly 44 and the ignition switch 34 taught by the above-disclosed preferred embodiment of the present invention is economical, reliable, and retains the traditional control features and positions expected and desired by operators.

While the preferred embodiment of the present invention is shown and described herein, it is to be understood that the same is not so limited but shall cover and include any and all modifications thereof which fall within the purview of the invention.

What is claimed is:

1. An ignition system for a portable power tool, comprising:

a choke assembly manually movable between a normal, first position and a choking, second position;

an ignition switch manually movable between a run position and a stop position; and, a member operatively interconnecting said choke assembly and said ignition switch whereby movement of said choke assembly into said choking position moves said ignition switch into said run position, and wherein said ignition switch is freely movable independent of said choke assembly when said choke assembly is in said normal position.

2. An ignition system according to claim 1, wherein said ignition switch forms a portion of an ignition circuit, said ignition switch permitting ignition of a fuel-air mixture within an engine when in said run position and preventing ignition when in said stop position.

3. An ignition system according to claim 2, wherein said choke assembly includes a handle and a shaft, said shaft being operatively connected to a carburetor and being adapted to adjust a fuel-air ratio of a mixture supplied by the carburetor to the engine.

4. An ignition system according to claim 3, wherein said handle and shaft are relatively inward when in said first position and are relatively extended when in said second position.

5. An ignition system according to claim 1, wherein said member is a lever integrally formed with said ignition switch.

6. An ignition system according to claim 5, wherein said choke assembly includes a handle and a shaft, said shaft being operatively connected to a carburetor and being adapted to adjust a fuel-air ratio of a mixture supplied by the carburetor to an engine, said handle and shaft being relatively inward when in said first position and being relatively extended when in said second position.

7. An ignition system according to claim 6, wherein movement of said handle and shaft into said second position rotates said lever which, in turn, pivots said ignition switch from the stop position into the run position.

8. An ignition system according to claim 7, wherein said shaft has a depending arm which engages and rotates said lever as said handle and shaft move longitudinally from said first position toward said second position.

9. An ignition system for a portable power tool, comprising:

a choke assembly including a user-engageable handle and a shaft, said choke assembly being movable between a normal, first position wherein said handle and shaft are relatively inward and a choking, second choke position wherein said handle and shaft are relatively extended;

an ignition switch forming a portion of an ignition circuit and being movable between a run position in which ignition is permitted and a stop position in which ignition is prevented; and, a member operatively interconnecting said choke assembly and said ignition switch whereby movement of said choke assembly into said second position moves said ignition switch into said run position, and wherein said ignition switch is freely movable independent of said choke assembly when said choke assembly is in said first position.

10. An ignition system according to claim 9, wherein said member is a lever which is integrally formed with said ignition switch.

11. An ignition system according to claim 10, wherein longitudinal movement of said handle and shaft from said first position to said second position rotates said lever which, in turn, moves the ignition switch from said stop position to said run position.

12. An ignition system according to claim 11, wherein said shaft has a depending arm which engages and rotates said lever as said handle and shaft move from said first position to said second position, rotation of said lever causing said ignition switch to pivotally move from said stop position to said run position.

13. A portable power tool, comprising:

an engine secured to a chassis;

a carburetor mounted operable to supply a fuel-air mixture to said engine for combustion therein;

a choke assembly operatively connected to said carburetor to adjust a fuel-air ratio of said mixture supplied to said engine, said choke assembly including a user-engageable handle which is movable between a normal, first position and a choking, second position, said fuel-air mixture being fuel rich when said choke assembly is in said second position;

an ignition switch movable between a run position permitting ignition of the fuel-air mixture within the engine and a stop position preventing ignition of said mixture;

a member operatively interconnecting said choke assembly and said ignition switch whereby movement of said choke assembly from said first position to said second position moves said ignition switch from said stop position to said run position and permits starting of said engine while a fuel rich mixture is introduced therein via said carburetor.

14. A portable power tool according to claim 13, wherein said member is a lever integrally formed with said ignition switch.

15. A portable power tool according to claim 14, wherein said choke assembly includes a shaft which extends inwardly from said handle and is operatively connected to said carburetor.

16. A portable power tool according to claim 15, wherein said lever has an offset portion underlying said shaft, said offset portion being engaged by said shaft as said shaft and handle are moved from said first position into said second position.

17. A portable power tool according to claim 16, wherein said shaft has a depending arm, said arm being operable to engage said offset portion and rotate said lever when said handle and shaft are moved from said first position into said second position, rotation of said lever pivoting said ignition switch from said stop to said run position.

* * * * *